US005851167A

United States Patent [19]

Li

[11] Patent Number: 5,851,167

[45] Date of Patent: Dec. 22, 1998

[54] EXERCISER

[76] Inventor: Tianfu Li, 27165 Colleen Ct., Dearborn Hts, Mich. 48127

[21] Appl. No.: 859,859

[22] Filed: May 21, 1997

[51] Int. Cl.[6] ..... A63B 21/02

[52] U.S. Cl. ..... 482/122; 422/124; 422/125; 422/126

[58] Field of Search ..... 422/121, 122, 422/124, 125, 126

[56] References Cited

U.S. PATENT DOCUMENTS

| | | | |
|---|---|---|---|
| 3,540,724 | 11/1970 | Hunter | 482/121 |
| 4,852,873 | 8/1989 | O'Donnell et al. | 482/122 |
| 4,852,874 | 8/1989 | Sleichter, III et al. | 482/122 |
| 4,856,776 | 8/1989 | Ching-Liang | 482/122 |
| 4,900,015 | 2/1990 | Dissinger | 482/121 |
| 5,176,622 | 1/1993 | Anderson et al. | 482/124 |
| 5,514,055 | 5/1996 | Elliot | 482/121 |
| 5,514,058 | 5/1996 | Buoni et al. | 482/124 |
| 5,556,368 | 9/1996 | Akin | 482/121 |
| 5,643,160 | 7/1997 | Huang | 482/122 |

*Primary Examiner*—Lynne A. Reichard

[57] ABSTRACT

A device for use to increase muscular strength including an elastic ring providing flexible resistance to force applied to the ring by a user, the ring having first laterally opposite sides and elevated arms rising and falling along a curved path from the sides forming a saddle-like contour, a first pair of laterally opposed grips covering the sides, and a second pair of laterally opposed grips covering the arms, the ring being formed of an elastic rod, a spiral spring, or multiple interconnected spiral springs.

16 Claims, 3 Drawing Sheets

EXERCISER

BACKGROUND OF THE INVENTION

1. Field Of The Invention

This invention relates generally to a device for exercising the human body in order to improve muscular strength. More particularly it pertains to a portable, full body exercise device.

2. Description Of The Prior Art

U.S. Pat. No. 5,569,137 discloses a device for exercising the arms, legs and abdomen by pulling a resilient member and pulling or bending a hollow tube-like spiral spring. This devices does not exercise the adductor muscles of the arms and legs.

U.S. Pat. Nos. 5,399,138 and 4,483,533 disclose an abduction and adduction exerciser operated by pushing a helical bias device. However, the exercisers described there do not exercise muscles of the back or the flexion-extension muscles of the arms and legs.

SUMMARY OF THE INVENTION

It is a primary object of the present invention to provide an exerciser having a saddle-shaped ring made of material that will elastically resist forces applied by the user, the ring having pairs of grips spaced mutually apart, the grips providing surfaces for holding and applying force to the ring during exercise. A pair of detachable ropes or straps may be secured to the ring to enable gripping or holding the exerciser device by the user's hands and feet, thereby facilitating its use in a broad range of exercise movements by various parts of the human body.

DESCRIPTION OF A PREFERRED EMBODIMENT

Figure 1:
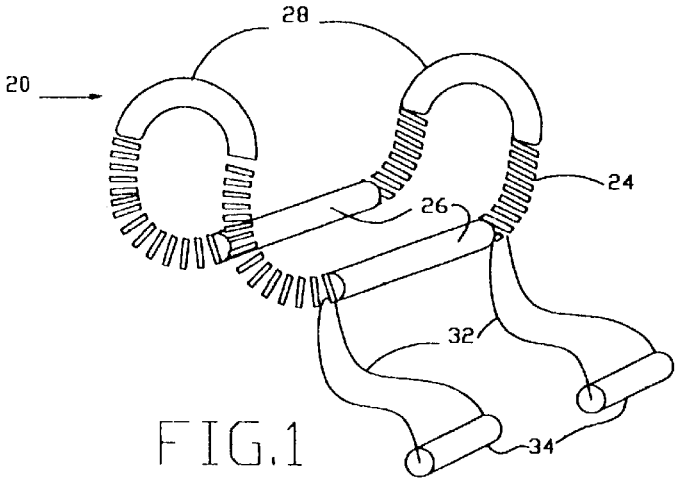
FIG. 1 is a perspective view of the present invention.
Figure 2:
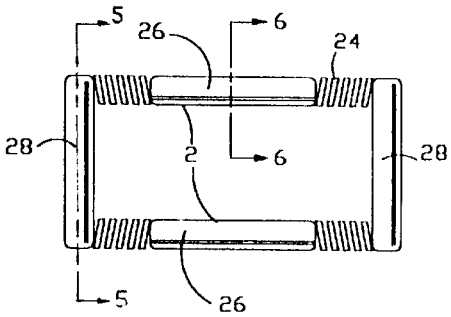
FIG. 2 is a top view of the elastic ring showing a preferred location of various grips.
Figure 3:
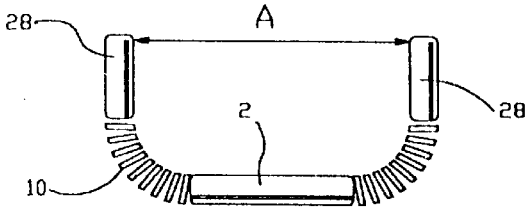
FIG. 3 is a front view of the elastic ring of FIG. 2.
Figure 4:
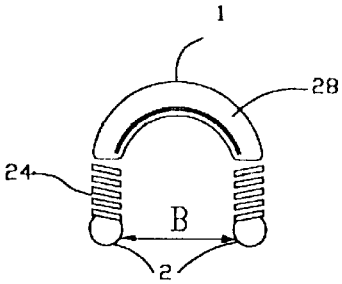
FIG. 4 is a side view of the elastic ring of FIG. 2.
Figure 5:
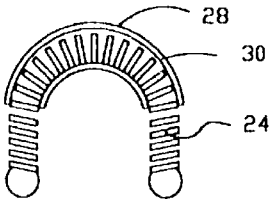
FIG. 5 is a cross section of the exerciser taken at plane 5—5 of FIG. 2.
Figure 6:
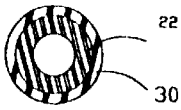
FIG. 6 is a cross section of the exerciser taken at plane 6—6 of FIG. 2 showing the elastic ring formed from a rod.

Referring first to FIGS. 1–6, the exerciser of the present invention includes an elastic ring 20 having a saddle-like shape or contour comprising laterally opposite sides spaced mutually at distance B, and elevated arms connected to the sides, rising and falling from the sides, located at mutually opposite sides and spaced mutually at distance A, a preferred contour of the ring being seen best in FIGS. 1 and 3. Preferably the sides are substantially straight, mutually parallel and located in a plane. Portions of the ring may be curved to have differing radii. Preferably two portions of the elastic ring have the same radius of curvature.

The ring 20 may be formed from an elastic, flexible rod 22, one spiral spring 24, or several interconnected spiral spring portions.

Preferably at least two pairs of grips 26, 28 cover portions of the length of the outer surface of the elastic rod or spring, each member of a grip pair being covered by a pad 30 and spaced apart from a corresponding pair member by distances A and B, respectively.

Preferably at least two detachable ropes 32 having grips 34 are secured to the ring 20, the length of the ropes being varied to accommodate the size of the user of the exercise device.

The distances A, B between the sides of ring 20 and grips 26, 28, the radii and height of the arms, and elastic stiffness of the ring are established to produce a preferred resistance of the exerciser to force applied by the user.

Figure 7:
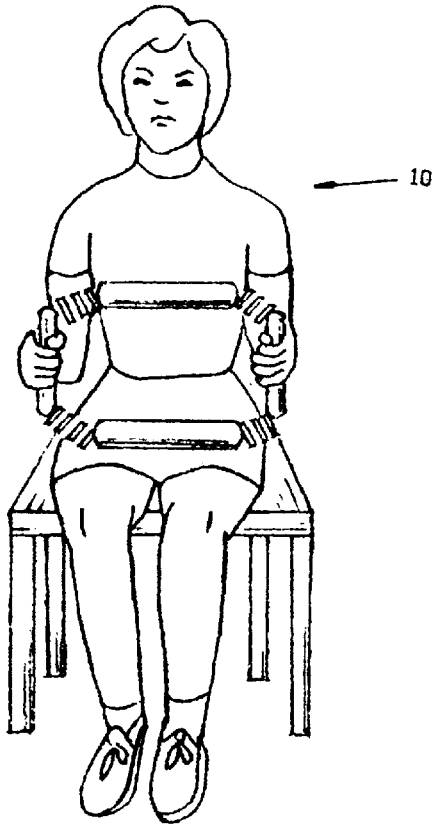
FIG. 7 is a perspective view of the present invention in use for abduction-adduction exercise.

The user can exercise abduction-adduction muscular strength of the arms by pushing and pulling the grip pairs as shown in FIG. 7.

Figure 8:
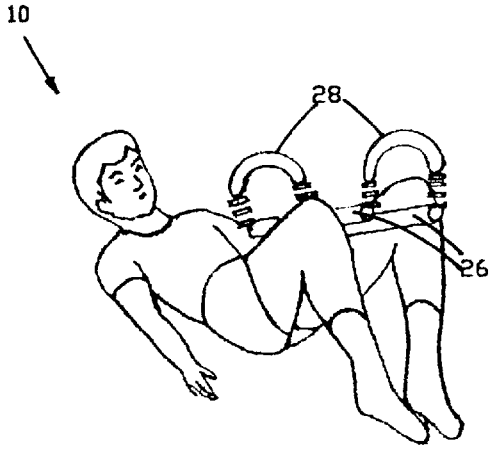
FIG. 8 is a perspective view of the present invention in use for leg adduction exercise.
Figure 9:
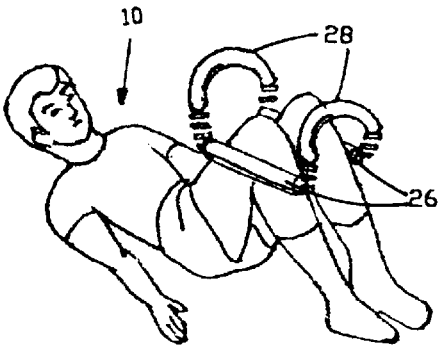
FIG. 9 is a perspective view of the present invention in use for leg abduction exercise.

The user can push or pull a pair of grips toward or away from each other to strengthen exercise abduction-adduction muscular strength of the legs as shown in FIGS. 8 and 9.

Figure 10:
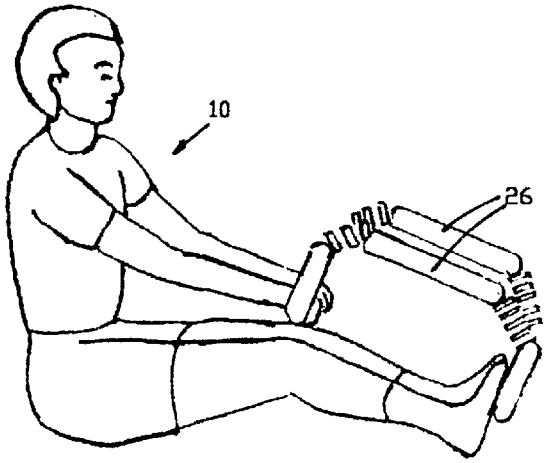
FIG. 10 is a perspective view of the present invention in use for back muscular exercise.

While sitting on a floor, the user can exercise back muscles by stabilizing or gripping the exercise ring with the feet and pulling a grip or rope with the hands, as shown in FIG. 10.

Figure 11:
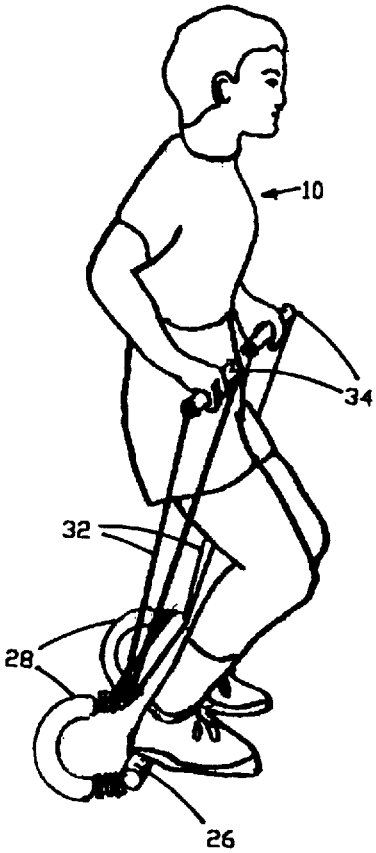
FIG. 11 is a perspective view of the present invention in use for arm flexion and leg extension exercise.

The user can exercise the muscles associated with arm flexion and leg extension by stepping on one grip and pulling the opposite grip by applying force to the ropes, as shown in FIG. 11.

The present invention can be used in many other ways than those illustrated here to achieve various types of exercising effects. In another embodiment of the present invention, the rope can be formed of resilient elastic material.

It is to be understood that the above-description and drawing are only used for illustrating some embodiments of the present invention, but are not intended to limit the scope thereof. Any variation and deviations from the above description and drawing should be included in the scope of the present invention.

I claim:

1. An exercise device, comprising:

an elastic ring providing flexible resistance to force applied to the ring by a user, said ring defining a length having a saddle-like contour; and a first pair of laterally opposed grips covering a first portion of the ring length.

2. The exercise device of claim 1 further comprising a rope detachably secured to the ring, the rope extending from the ring and supporting grips attached thereto.

3. The exercise device of claim 1 wherein the ring comprises:

laterally opposite sides extending along the ring; and laterally opposite arms extending along the ring, each arm interposed between, and connected to an adjacent side, defining a rising and falling curved contour between said sides.

4. The exercise device of claim 3 wherein the curves of the arms includes arcs having mutually different radii of curvature.

5. The exercise device of claim 3 wherein the curves of the arms have the same radius of curvature.

6. The exercise device of claim 1 wherein the ring is formed of an elastic flexible rod.

7. The exercise device of claim 1 wherein the ring is formed of a spiral spring.

8. The exercise device of claim 1 wherein the ring comprises several spiral springs, each spring extending along a portion of the ring and mutually interconnected by a component interposed between each spring.

9. The exercise device of claim 1, further comprising a second pair of laterally opposed grips covering a second portion of the ring length, the first pair of grips covering the sides, the second pair of grips covering the arms.

10. The exercise device of claim 1 wherein the grips are covered by a pad of a material that provides comfort in gripping the device.

11. The exercise device of claim 1 wherein the rope is of an elastic material.

12. An exercise device, comprising:

an elastic ring providing flexible resistance to force applied to the ring by a user, said ring having laterally opposite sides extending along the ring substantially straight, parallel and located in a plane; laterally opposite arms extending along the ring, each arm interposed between and connected to an adjacent side, defining a rising and falling curved contour between said sides;

a first pair of laterally opposed grips covering the sides; and a second pair of laterally opposed grips covering the arms.

13. The exercise device of claim 12 further comprising a rope detachably secured to the ring, the rope extending from the ring and supporting grips thereon.

14. The exercise device of claim 12 wherein the ring is formed of an elastic flexible rod.

15. The exercise device of claim 12 wherein the ring is formed of a spiral spring.

16. The exercise device of claim 12 wherein the ring comprises several spiral springs, each spring extending along a portion of the ring and mutually interconnected by a component interposed between each spring.

* * * * *